US005378578A

United States Patent [19]

Hoshimiya et al.

[11] Patent Number: 5,378,578

[45] Date of Patent: Jan. 3, 1995

[54] SILVER HALIDE PHOTOGRAPHIC PHOTOSENSITIVE MATERIALS

[75] Inventors: Takashi Hoshimiya; Toshihide Ezoe; Kazunobu Katoh, all of Kanagawa, Japan

[73] Assignee: Fuji Photo Film Co., Ltd., Kanagawa, Japan

[21] Appl. No.: 151,204

[22] Filed: Nov. 12, 1993

[30] Foreign Application Priority Data

Nov. 12, 1992 [JP] Japan ..... 4-302603

[51] Int. Cl.[6] ..... G03C 1/06

[52] U.S. Cl. ..... 430/264; 430/598

[58] Field of Search ..... 430/264, 598

[56] References Cited

U.S. PATENT DOCUMENTS

| | | | |
|---|---|---|---|
| 4,929,535 | 5/1990 | Takahashi et al. | 430/264 |
| 4,994,365 | 2/1991 | Looker et al. | 430/598 |
| 5,126,227 | 6/1992 | Machonkin et al. | 430/264 |
| 5,279,919 | 1/1994 | Okamura et al. | 430/264 |

FOREIGN PATENT DOCUMENTS

| | | | |
|---|---|---|---|
| 0034853 | 2/1993 | Japan | 430/598 |

*Primary Examiner*—Thomas R. Neville

*Attorney, Agent, or Firm*—Sughrue, Mion, Zinn, Macpeak & Seas

[57] ABSTRACT

A silver halide photographic photosensitive material comprises a compound represented by the following formula (I):

$$R^6\text{-}(L^1\text{-}R^1\text{-}A^{\oplus}\text{-}R^2\text{-}L^2\text{-}(R^3\text{-}L^3)_m\text{-}R^4\text{-}NHNH\text{-}G^1\text{-}R^5)_n \quad (I)$$

$$X^{\ominus}$$

The variables in this formula are defined in the specification.

Also disclosed is a method for processing this photosensitive material with a developer which has a pH 9.0 to 11.0 and which contains 0.15 to 1.5 mol/liter or more of sulfite ion.

9 Claims, No Drawings

SILVER HALIDE PHOTOGRAPHIC PHOTOSENSITIVE MATERIALS

FIELD OF THE INVENTION

This invention concerns silver halide photographic photosensitive materials and a method of forming ultra-high contrast negative images in which these materials are used, and in particular it concerns silver halide photographic photosensitive materials which are used in a photographic plate-making process.

BACKGROUND OF THE INVENTION

The addition of hydrazine compounds to silver halide photographic emulsions and developers has been described in U.S. Pat. No. 3,730,727 (developer in which ascorbic acid and hydrazine are combined), in U.S. Pat. No. 3,227,552 (hydrazine is used as an auxiliary developing agent for obtaining direct positive color images), in U.S. Pat. No. 3,386,831 (β-monophenylhydrazides of aliphatic carboxylic acids are included as stabilizers for silver halide sensitive materials), in U.S. Pat. No. 2,419,975, and by Mees in *The Theory of Photographic Process*, third edition, (1966), page 281.

From among these literature references, the fact that ultra-high contrast negative images can be obtained by adding hydrazine compounds has been disclosed in particular in U.S. Pat. No. 2,419,975.

In the same patent specification it is disclosed that photographic characteristics which have a very high contrast with a gamma (γ) value exceeding 10 can be obtained if hydrazine compounds are added to a silver chlorobromide emulsion and the material is developed in a high pH developer at a pH value of 12.8. However, a strongly alkaline solution at a pH approaching 13 is susceptible to aerial oxidation and is unstable, and it will not stand up to long term storage or use.

Attempts have been made to form high contrast images by developing silver halide photosensitive materials which contain hydrazine compounds in developers of a lower pH.

Methods of processing in which development is carried out in a developer of a pH not more than 11.0 using sensitive materials which contain nucleation development accelerators which have groups which are adsorbed onto silver halide emulsion grains and nucleating agents which have similar adsorption groups have been disclosed in JP-A-1-179939 and JP-A-1-179940. (The term "JP-A" as used herein signifies an "unexamined published Japanese patent application".) However, when compounds which have adsorbing groups are added to a silver halide emulsion there may be a loss of photosensitivity if a certain critical amount is exceeded, development may be inhibited, or the action of other useful additives which are adsorbed may be impeded, and so the amount which is used is limited and satisfactory high contrast properties cannot be realized.

Hydrazine compounds which have ethylene oxide repeating units and hydrazine compounds which have pyridinium groups have been disclosed in U.S. Pat. Nos. 4,998,604 and 4,994,365. However, as is clear from the illustrative examples provided, the high contrast properties are inadequate and it is difficult to obtain the $D_{max}$ which is required and high contrast under practical development processing conditions.

Furthermore, with nucleation high contrast sensitive materials in which hydrazine derivatives are used the variation in photographic speed and gradation due to developer fatigue is considerable and attempts have been made to improve the processing stability. With the existing technology it has not been possible to obtain sensitive materials which retain a satisfactory high contrast and which exhibit good processing stability even when processed in a developer of a pH less than 11.

SUMMARY OF THE INVENTION

One object of this invention is to provide silver halide photographic photosensitive materials for plate-making purposes which have excellent rapid processing properties and high processing stability.

Another object of this invention is to provide silver halide photographic photosensitive materials for plate-making purposes which can be developed at a low pH.

These and other objects of the invention have been realized by means of a silver halide photographic photosensitive material which comprises a compound represented by the general formula (I) indicated below.

General Formula (I)

$$R^6\text{-}(L^1\text{-}R^1\text{-}A^{\oplus}\text{-}R^2\text{-}L^2\text{-}(R^3\text{-}L^3)_m\text{-}R^4\text{-}NHNH\text{-}G^1\text{-}R^5)_n \quad X^{\ominus}$$

In this formula, $L^1$ and $L^2$ represent a single bond, —O—, —S—, —$NR^7$—, —CO—, —$SO_2$—, —P(O) ($G^2R^7$)— or combinations of these groups, and $L^3$ represents —$SO_2NR^7$—, —$NR^7SO_2NR^7$—, —$CONR^7$—, —$NR^7CONR^7$—, or —$G^2P(O)(G^2R^7)NR^7$—.

$G^1$ represents —CO—, —$SO_2$—, —SO—, —CO-CO—, a thiocarbonyl, group, an iminomethylene or —P(O) ($G^2R^7$)—, and $G^2$ represents a single bond, —O— or —$NR^7$—.

$R^1$, $R^2$, $R^3$ and $R^4$ represent divalent aliphatic groups or aromatic groups, $R^5$ represents a hydrogen atom, an aliphatic group, an aromatic group, an alkoxy group, an aryloxy group or a substituted or unsubstituted amino group, and $R^7$ represents a hydrogen atom, an aliphatic group or an aromatic group.

$A^+$ represents a quaternary ammonium cation group, a tertiary sulfonium cation group or a quaternary phosphonium cation group.

Moreover, m is 0 or 1 and n is 1 or 2, and $X^-$ represents a counter anion or a counter anion part in cases where an intramolecular salt is formed.

In cases where n=1, $R^6$ represents an aliphatic group or aromatic group which contains a quaternary ammonium cation, a tertiary sulfonium cation or a quaternary phosphonium cation.

In cases where n=2, $R^6$ represents a single bond, —O—, or a divalent aliphatic group or aromatic group.

DETAILED DESCRIPTION OF THE INVENTION

The compounds represented by general formula (1) are described in detail below.

The aliphatic groups represented by $R^1$, $R^2$, $R^3$ and $R^4$ in general formula (I) are preferably groups of a carbon number 1 to 30, and especially linear chain, branched or cyclic alkylene groups of a carbon number 1 to 20.

The aromatic groups represented by $R^1$, $R^2$, $R^3$ and $R^4$ in general formula (I) are single ring or double ring arylene groups or unsaturated heterocyclic groups. Here, an unsaturated heterocyclic group may be condensed with an aryl group.

The aliphatic groups and aromatic groups represented by $R^1$, $R^2$, $R^3$ and $R^4$may be substituted groups. Typical substituent groups include, for example, alkyl groups, aralkyl groups, alkenyl groups, alkynyl groups, alkoxy groups, aryl groups, substituted amino groups, ureido groups, urethane groups, aryloxy groups, sulfamoyl groups, carbamoyl groups, alkyl or aryl thio groups, alkyl or aryl sulfonyl groups, alkyl or aryl sulfinyl groups, a hydroxy group, halogen atoms, a cyano group, a sulfo group, aryloxycarbonyl groups, acyl groups, alkoxycarbonyl groups, acyloxy groups, carboxylic acid amido groups, sulfonamido groups, carboxyl group, phosphoric acid amido groups, diacylamino groups and imido groups. The preferred substituent groups include alkyl groups (preferably of a carbon number 1 to 20), aralkyl groups (preferably of a carbon number 7 to 30), alkoxy groups (preferably of a carbon number 1 to 20), substituted amino groups (preferably amino groups substituted with alkyl groups of a carbon number 1 to 20), acylamino groups (preferably those which have a carbon number of 2 to 30), sulfonamido groups (preferably those which have a carbon number of 1 to 30), ureido groups (preferably those which have a carbon number of 1 to 30) and phosphoric acid amido groups (preferably of a carbon number 1 to 30). These groups may be further substituted.

Alkylene groups are preferred for $R^1$ and $R^2$.

Arylene groups are preferred for $R^3$ and $R^4$, and they are most desirably groups which contain a benzene ring.

Alkyl groups of carbon number 1 to 4 are preferred for the aliphatic groups represented by $R^5$ in general formula (I), and single ring or double ring aryl groups (for example those which contain a benzene ring) are the preferred aromatic groups. Preferred alkoxy groups, aryloxy groups, and substituted amino groups each have 1 to 4, 6 to 10, and 2 to 6 carbon atoms, respectively.

In cases where $G^1$ is a —CO— group, of the groups which can be represented by $R^5$ the hydrogen atom, the alkyl groups (for example, methyl, trifluoromethyl, 3-hydroxypropyl, 3-methanesulfonamidopropyl, phenysulfonylmethyl, phenoxymethyl, methoxymethyl, pyridiniomethyl), the aralkyl groups (for example, o-hydroxybenzyl), and the aryl groups (for example phenyl, 3,5-dichlorophenyl, o-methanesulfonamidophenyl, 4-methanesulfonylphenyl, 2-hydroxymethylphenyl), for example, are preferred, and the alkyl groups which are substituted winy electron-withdrawing groups, and the hydrogen atom, are especially desirable.

$R^5$ may be substituted, and the substituent groups listed in connection with $R^1$, $R^2$, $R^3$ and $R^4$ can be used as substituent groups.

A —CO— group is most desirable for $G^1$ in general formula (I).

Furthermore, $R^5$ may be such that the $G^1$-$R^5$ part separates from the rest of the molecule and a cyclization reaction in which a ring structure which contains the atoms of the —$G^1$-$R^5$ part is formed occurs. Such a case has been disclosed, for example, in JP-A-63-29751.

$R^7$ is preferably a hydrogen atom or an alkyl group of a carbon number 1 to 6, and it is most desirably a hydrogen atom. Furthermore, in those cases where the compounds represented by general formula (I) contain two or more $R^7$ or $G^2$ groups, these groups may be the same or different.

$L^1$ and $L^2$ in general formula (I) represent a single bond, —O—, —S—, —$NR^7$—, —CO—, —$SO_2$—, —P(O) ($G^2R^7$)— or combinations of these groups, and $L^2$ preferably represents —$SO_2NR^7$—, —$NR^7SO_2NR^7$—, —$CONR^7$—, —$NR^7CONR^7$ or —$G^2P(O)(G^2R^7)NR^7$—, and it is most desirably a —$CONR^7$— group.

From among the groups represented by $L^3$ in general formula (I), the —$SO_2NR^7$— group is especially desirable.

The value of m in general formula (I) is preferably 1, but it may zero.

A+ in general formula (I) represents a quaternary ammonium cation group, a tertiary sulfonium cation group or a quaternary phosphonium cation group. It is preferably represented by general formula (II), general formula (III), general formula (IV), general formula (V) or general formula (VI) indicated below:

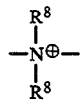

General Formula (II)

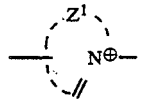

General Formula (III)

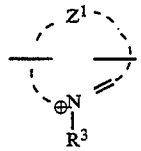

General Formula (IV)

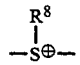

General Formula (V)

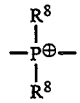

General Formula (VI)

In these formulae, $R^8$ represents an aliphatic group or an aromatic group. The aliphatic groups which can be represented by $R^8$ are preferably of a carbon number 1 to 30, and especially linear chain, branched or cyclic alkyl groups of a carbon number 1 to 20. The aromatic groups which can be represented by $R^8$ are single ring or double ring aryl groups or unsaturated heterocyclic groups. Here, an unsaturated heterocyclic group may be condensed with an aryl group.

Furthermore, the two $R^8$ groups in general formula (II) or general formula (VI) may be the same different, or they may be joined together to form a ring.

$Z^1$ represents a group of atoms which is required to form a nitrogen containing heterocyclic aromatic ring. Examples of nitrogen containing heterocyclic aromatic rings which can be formed with $Z^1$ and the nitrogen atom include a pyridine ring, a pyrimidine ring, a pyridazine ring, a pyrazine ring, an imidazole ring, an oxazole ring, a thiazole ring, structures in which these rings are condensed with a benzene ring, a pteridine ring and a naphthilidine ring.

$R^8$ and $Z^1$ may be substituted, and the groups described as substituent groups for $R^1$, $R^2$, $R^3$ and $R^4$ in general formula (I) can be cited as examples of these substituent groups.

An aliphatic group represented by $R^6$ in general formula (I) is preferably of a carbon number 1 to 30, and especially a linear chain, branched or cyclic alkyl group of a carbon number 1 to 20.

An aromatic group represented by $R^6$ in general formula (I) is a single ring or double ring aryl group or an unsaturated heterocyclic group. Here, an unsaturated heterocyclic group may be condensed with an aryl group.

The aliphatic groups and aromatic groups represented by $R^6$ may be substituted, and the groups described as substituent groups for $R^1$, $R^2$, $R^3$ and $R^4$ can be cited as being typical substituent groups.

In those cases where n=1 in general formula (I), the quaternary ammonium cation group, tertiary sulfonium cation group or quaternary phosphonium cation group which is included in $R^6$ may be included in these substituent groups.

The quaternary ammonium cation group, tertiary sulfonium cation group or quaternary phosphonium cation group which is included in $R^6$ is preferably one of those according to one of general formulas (II) to (VI). Moreover, these quaternary ammonium cation groups, tertiary sulfonium cation groups or quaternary phosphonium cation groups may be substituted by a group according to general formula (VII) indicated below.

General Formula (VII)

$$R^2—L^2—(R^3—L^3)_m—R^4—NHNH—G^1—R^5$$

$R^2$, $R^3$, $R^4$, $R^5$, $L^2$, $L^3$, m and $G^1$ in this formula have the same significance as in general formula (I).

In those cases where n=2 in general formula (I), $R^6$ may also contain the quaternary ammonium cation groups, tertiary sulfonium cation groups or quaternary phosphonium cation groups of the case where n=1.

$R^1$, $R^2$, $R^3$, $R^4$, $R^5$ or $R^6$ may incorporate a ballast group or a polymer normally used in immobile photographically useful additives such as couplers. A ballast group in a comparatively inert group in terms of photographic properties which has a carbon number of at least 8. Such groups can be selected, for example, from among alkyl groups, alkoxy groups, phenyl groups, alkylphenyl groups, phenoxy groups and alkylphenoxy groups. Furthermore, the polymer disclosed, for example, in JP-A-1-100530 can be cited as an example of a polymer.

A group which is strongly adsorbed on the surface of a silver halide grain may be incorporated into $R^1$, $R^2$, $R^3$, $R^4$, $R^5$ or $R^6$ in general formula (I). Adsorption groups of this type include thiourea groups, heterocyclic thioamido groups, mercaptoheterocyclic groups and triazole groups, for example, disclosed in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245 and JP-A-63-234246.

$X^-$ in general formula (I) preferably represents a halide ion (such as a chloride ion, bromide ion), an alkyl or aryl sulfonato ion, an alkyl or arylcarboxylato, $BR_4^-$, $ClO_4^-$ or $PF_6^-$.

Compounds which can be used in this invention are listed below, but the invention is not limited to these compounds.

Compound 1

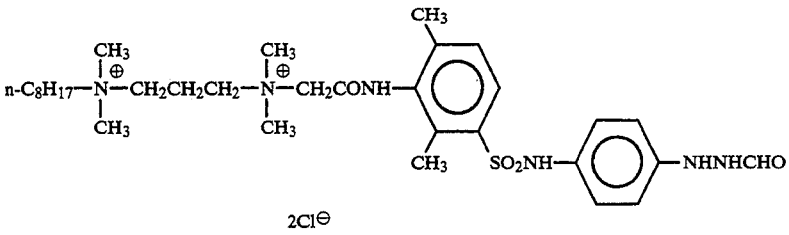

Compound 2

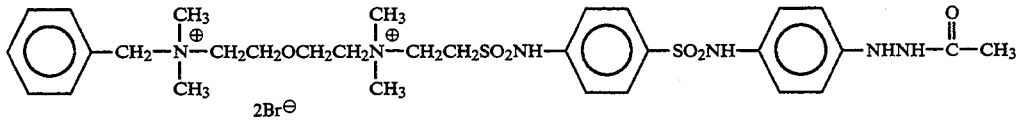

Compound 3

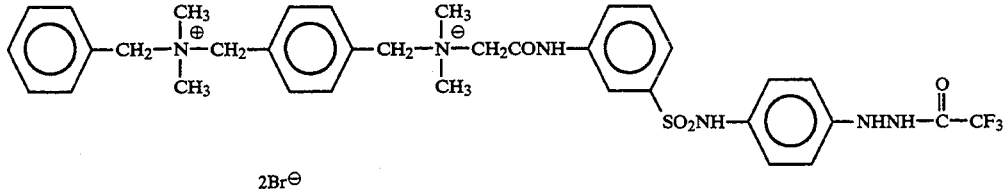

-continued
Compound 4
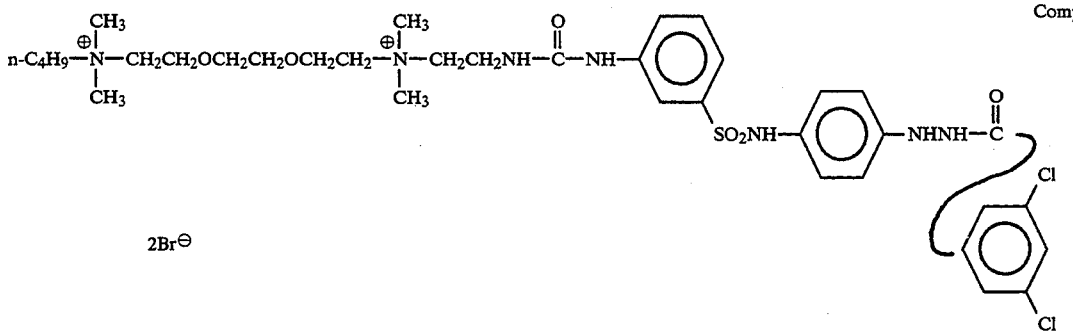
Compound 5
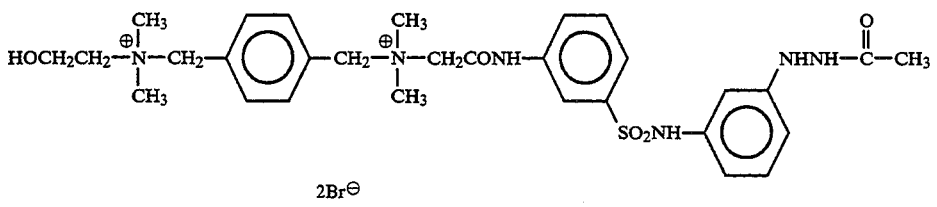
Compound 6
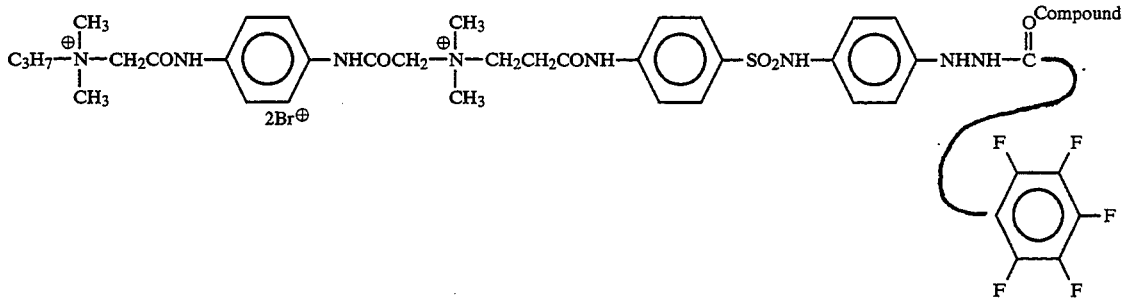
Compound 7
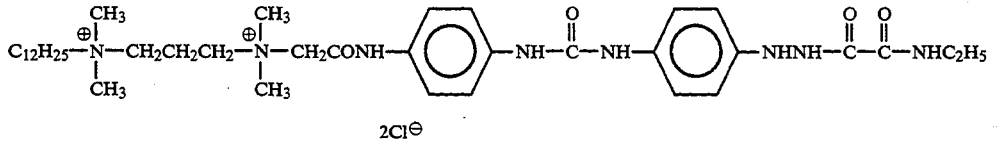
Compound 8
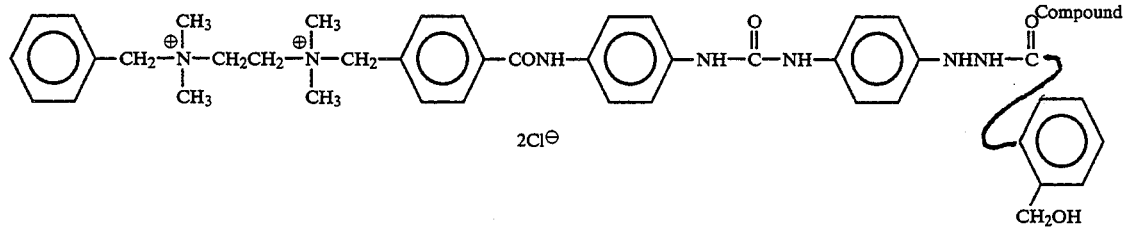
Compound 9
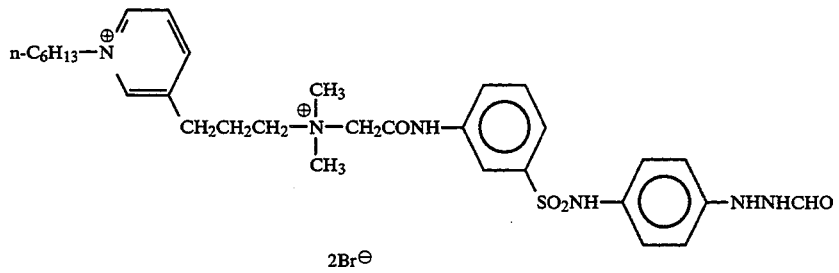

-continued
Compound 10
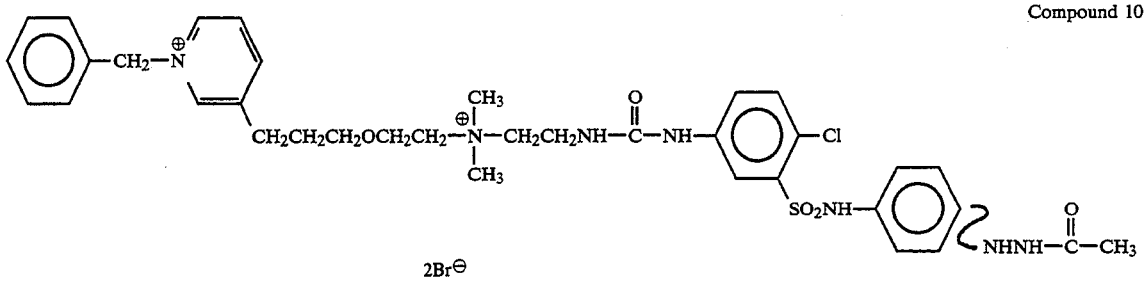
Compound 11
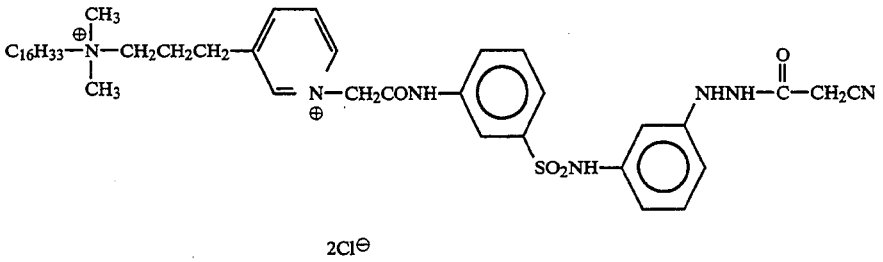
Compound 12
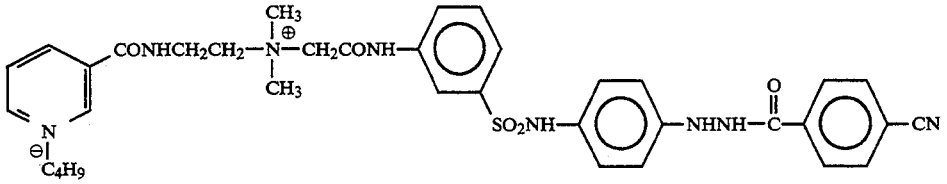
Compound 13
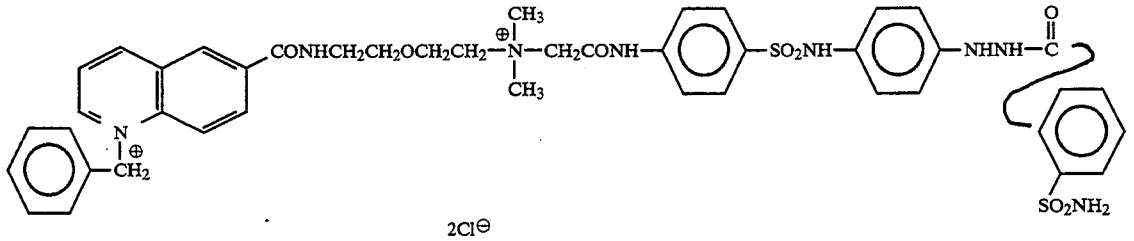
Compound 14
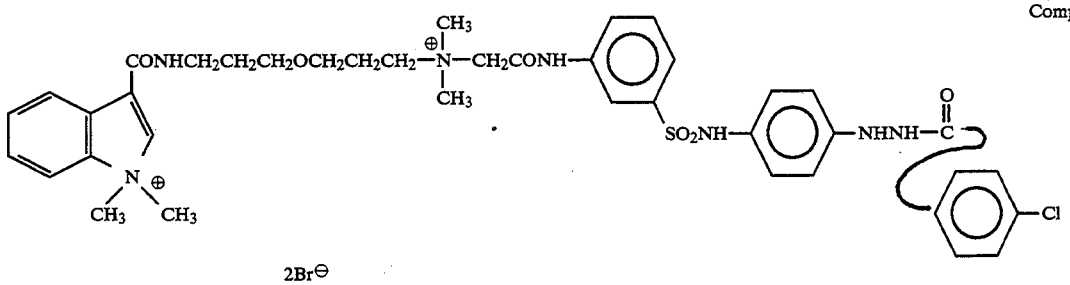
Compound 15
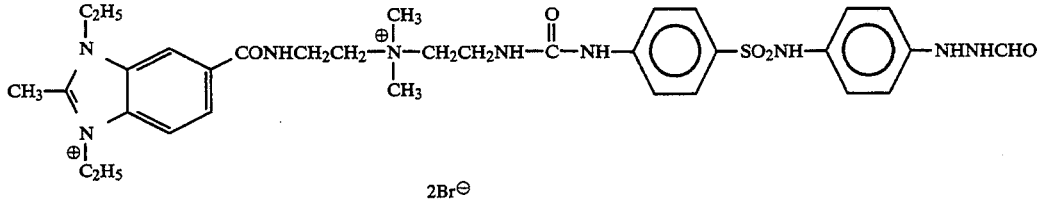

-continued
Compound 16
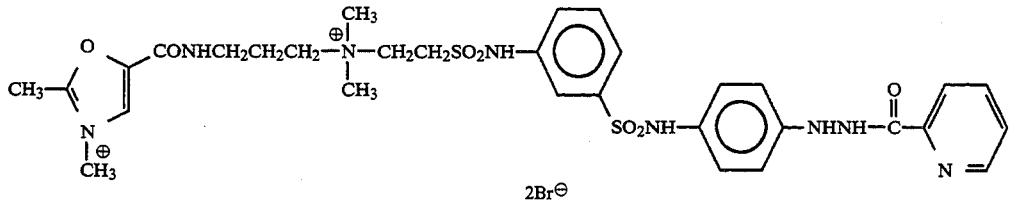
Compound 17
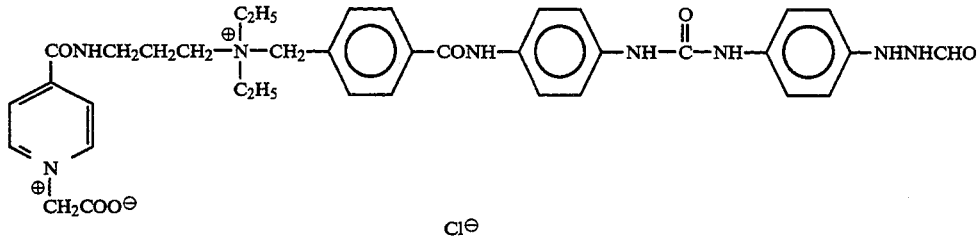
Compound 18
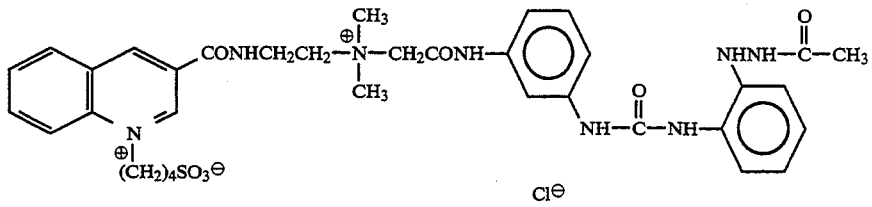
Compound 19
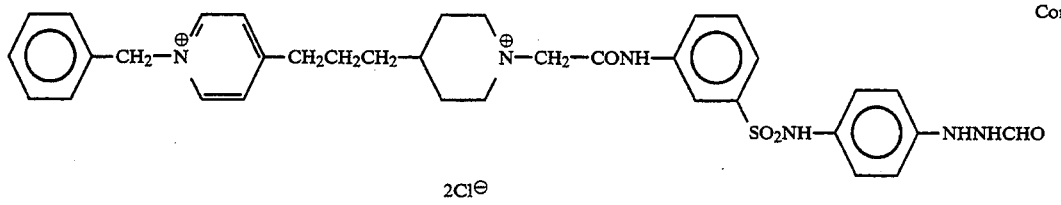
Compound 20
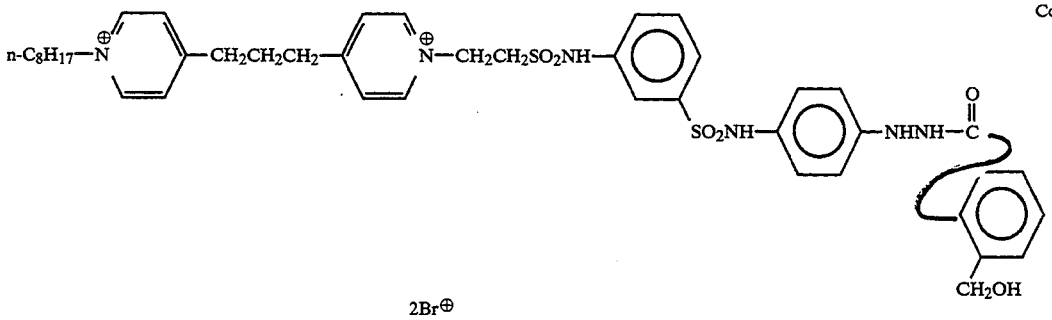
Compound 21
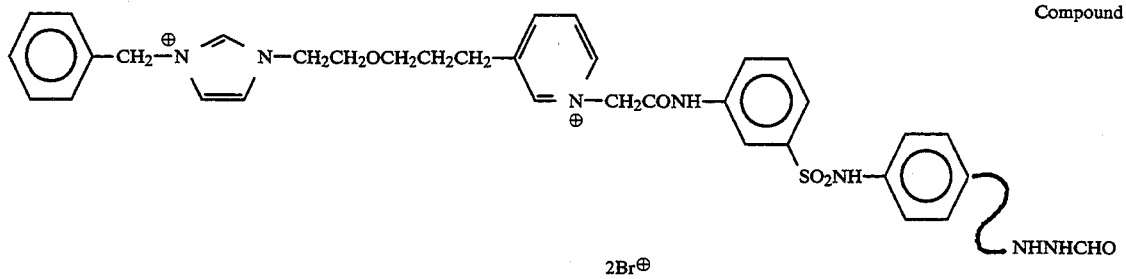

-continued
Compound 22
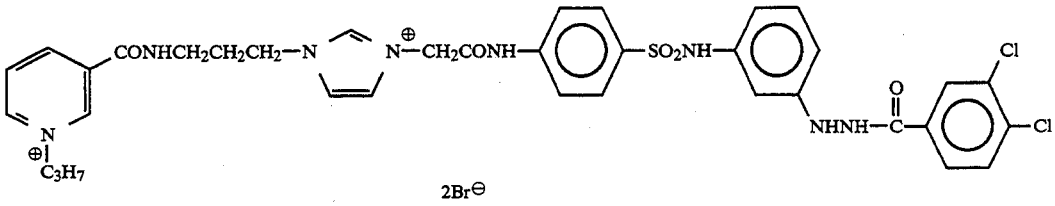
Compound 23
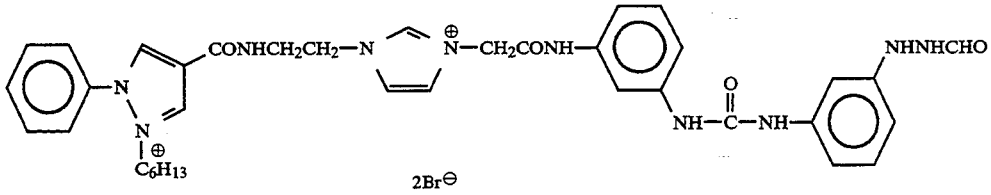
Compound 24
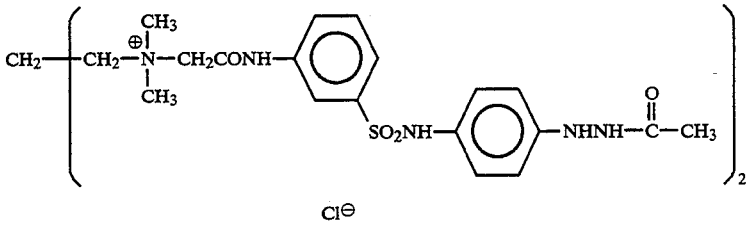
Compound 25
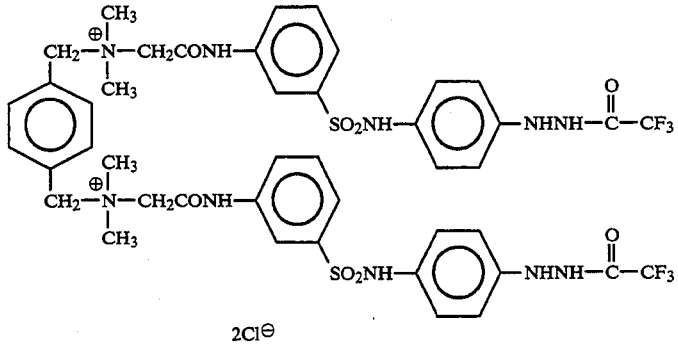
Compound 26
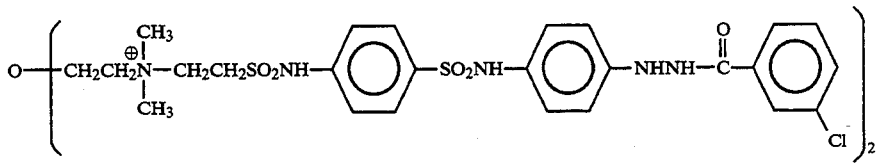
Compound 27
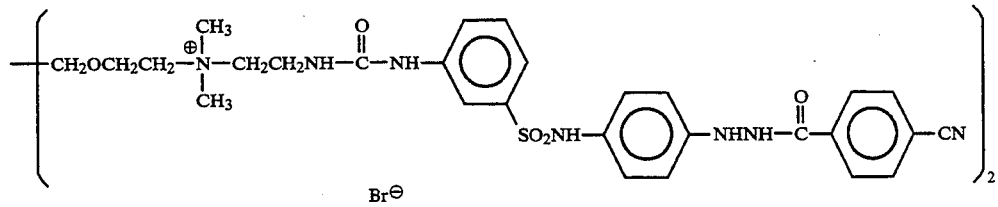

-continued
Compound 28
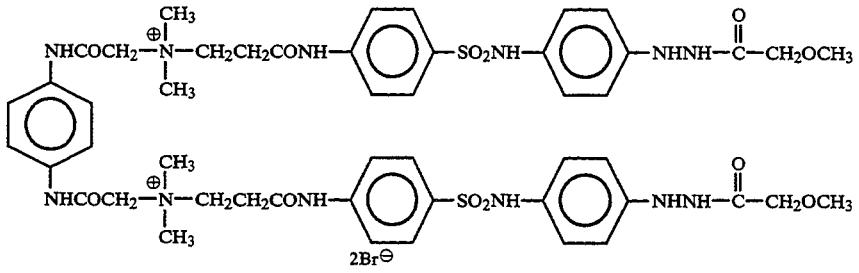
Compound 29
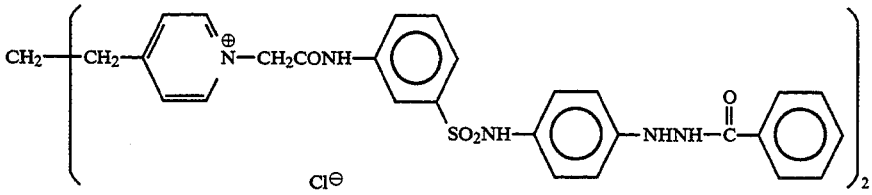
Compound 30
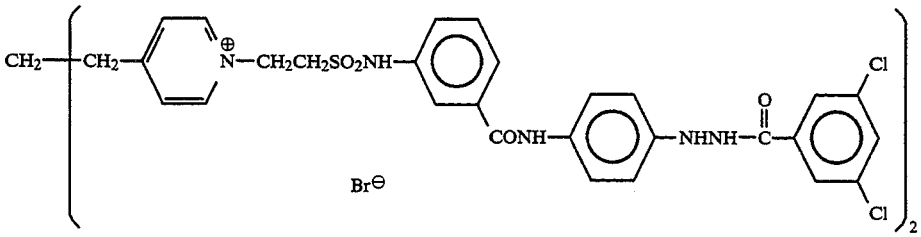
Compound 31
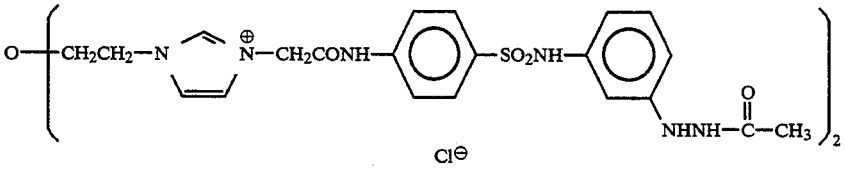
Compound 32
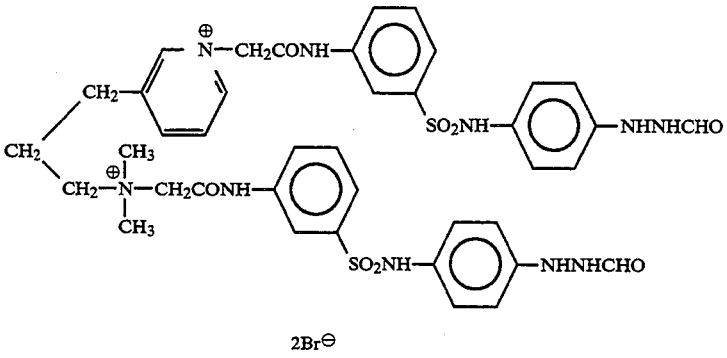
Compound 33
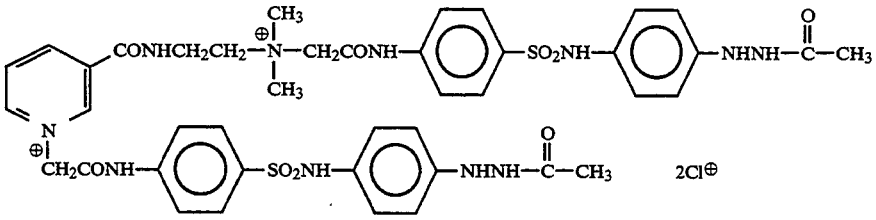

-continued

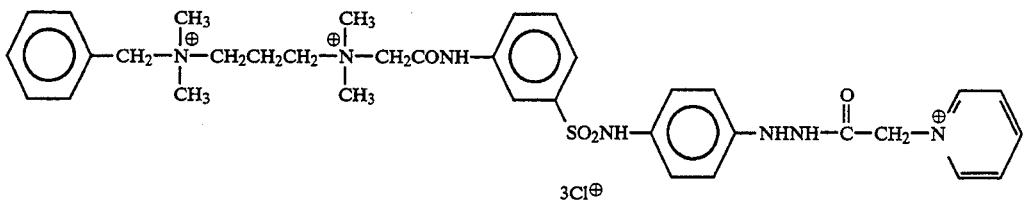

Compound 34

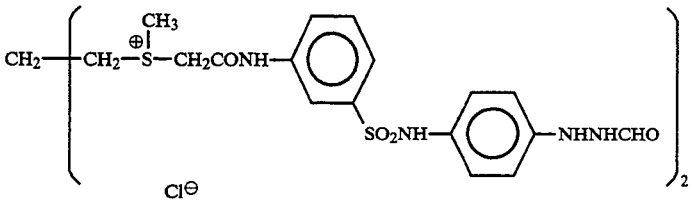

Compound 35

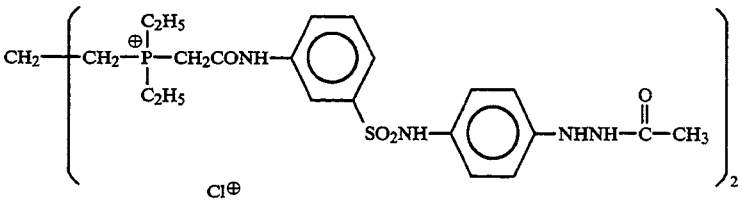

Compound 36

The hydrazine compounds of this invention can be prepared, for example, using the methods disclosed for example in JP-A-61-213847, JP-A-62-260153, U.S. Pat. No. 4,684,604, Japanese Patent Application 63-98803, U.S. Pat. Nos. 3,379,529, 3,620,746, 4,377,634 and 4,332,878, JP-A-49-129536, JP-A-56-153336, JP-A-56-153342 and U.S. Pat. Nos. 4,988,604 and 4,994,365.

The addition amount of the compounds of general formula (I) of this invention should be determined optimally, depending on the type of compound for example, but generally an amount within the range $1\times10^{-6}-5\times10^{-2}$ mol, and most desirably within the range $1\times10^{-5}-2\times10^{-2}$ mol, per mol of silver halide, is preferred.

The hydrazine derivative of the present invention can be used in the form of solution in a proper water-miscible solvent such as alcohol (e.g., methanol, ethanol, propanol, fluorinated alcohol), ketone (e.g., acetone, methyl ethyl ketone dimethylformamide, dimethylsulfoxide and methyl cellosolve.

As well known emulsion dispersion method can be used to dissolve the compound in an oil such as dibutyl phthalate, tricresyl phosphate, glyceryl triacetate and diethyl phthalate or auxiliary solvent such as ethyl acetate and cyclohexanone to mechanically prepare an emulsion dispersion. Alternatively, a method known as solid dispersion method can be used to disperse powdered compound of the present invention in water by means of a ball mill or colloid mill or by an ultrasonic apparatus.

The hydrazine derivative according to the present invention may be incorporated in any hydrophilic colloidal layer or silver halide emulsion layer, preferably silver halide emulsion layer, on the side the support carrying the silver halide emulsion layers which serve to form an image.

There is no need to use a conventional infectious developer or highly alkaline developer of a pH at least 11 to obtain photographic characteristics of ultra-high contrast using a silver halide photosensitive material of this invention, such as a developer disclosed in U.S. Pat. No. 2,419,975, ULTRA DEVELOPER (manufactured by Eastman Kodak Co., Ltd.) having pH 1.5 and GR-$D_1$ (manufactured by Fuji Photo Film Co., Ltd.) having pH 11.8, and a stable developer can be used.

That is to say, a silver halide photosensitive material of this invention can provide a negative image of satisfactorily ultra-high contrast with a developer of a pH 11.0 to 9.0 which contains 0.15 to 1.5 mol/liter of sulfite ion as a preservative.

It is possible to construct a stable processing system by using a developer of the preferred pH of 10.7 to 9.2.

No particular limitation is imposed upon the developing agents which can be used in the method of this invention. For example, dihydroxybenzenes (for example hydroquinone), 3-pyrazolidones (for example 1-phenyl-3-pyrazolidone and 4,4-dimethyl-1-phenyl-3-pyrazolidone) and aminophenols (for example, N-methyl-p-aminophenol) can be used either individually or in combinations.

The silver halide photosensitive materials of this invention are especially suited to processing in developers which contain dihydroxybenzenes as principal developing agents and 3-pyrazolidones or aminophenols as auxiliary developing agents. In these developers, the dihydroxybenzenes are preferably used in an amount of 0.05 to 0.5 mol/liter of developer, and the 3-pyrazolidones or aminophenols are preferably used in an amount of 0.001 to 0.06 mol/liter of developer.

Furthermore, the speed of development can be increased and the development time can be shortened by adding amines to the developer, as disclosed in U.S. Pat. No. 4,269,929.

Moreover, pH buffering agents such as alkali metal sulfites, carbonates, borates and phosphates, and development restrainers and anti-foggants such as bromide, iodide and organic anti-foggants (most desirably nitroindazoles or benzotriazoles) can also be included in the developer. Furthermore, hard water softening agents, dissolution promotors, toners, development accelerators, surfactants (most desirably poly(alkylene oxides), anti-foaming agents, film hardening agents, and agents for preventing silver contamination of the film (for example 2-mercaptobenzimidazole sulfonic acid) may also be included, as required.

Fixers of the composition generally used can be used for the fixer. In addition to thiosulfate and thiocyanate, the organic sulfur compounds which are known to have an effect as a fixing agent can be used fixing agents. Water soluble aluminum salts, for example, may be included in the fixer as film hardening agents.

The processing temperature in the method of this invention is generally selected between 18° C. and 50° C.

The use of an automatic processor for photographic processing is preferred, and even if the total processing time from the introduction of the photosensitive material into the automatic processor until it emerges from the processor is set to 90 to 120 seconds, with the method of this invention it is possible to obtain photographic characteristics with a negative gradation of a satisfactorily ultra-high contrast.

The compounds disclosed in JP-A-56-24347 can be used as agents for preventing the occurrence of silver contamination in the developer in this invention. The compounds disclosed in JP-A-61-267759 can be used as dissolution promotors which are added to the developer. Moreover, the compounds disclosed in JP-A-60-93433 or the compounds disclosed in JP-A-62-186259 can be used for the pH buffers which are used in the developer.

The silver halide emulsion to be incorporated in the silver halide photographic material according to the present invention is not limited in halogen composition but may be any of silver chloride, silver bromochloride, silver bromochloroiodide, silver bromide and silver bromoiodide. The silver halide grains may be cubic, tetradecahedral, octahedral, amorphous or tabular, preferably cubic. The average grain diameter of the silver halide grains is preferably in the range of 0.1 μm to 0.7 μm, more preferably 0.2 μm to 0.5 μm. The grain diameter distribution of the silver halide grains is as narrow as 15% or less, preferably 10% or less as calculated in terms of fluctuation coefficient represented by {(standard deviation of grain diameters)/(average grain diameter)}×100.

The silver halide grains may have a phase which is uniform all over the grain or phases differing from core to shell.

The preparation of silver halide grains to be used in the present invention can be accomplished by any suitable method as disclosed in P. Glafkides, "Chimie at Physique Photographique", Paul Montel, 1967, G. F. Duffin, "Photographic Emulsion Chemistry", The Focal Press, 1966, and V. L. Zelikman et al., "Making and Coating Photographic Emulsion", The Focal Press, 1964.

The reaction between a soluble silver salt and a soluble halogen salt can be carried out by any of a single jet process, a double jet process, a combination thereof, and the like.

A method in which grains are formed in the presence of excess silver ions (so-called reverse mixing method) may be used. Further, a so-called controlled double jet process, in which a pAg value of a liquid phase in which silver halide grains are formed maintained constant, may also be used. Further, a so-called silver halide solvent such as ammonia, thioether and four-substituted thioruea is preferably used to form grains.

More preferably, a tetra-substituted thiourea compound is used. Such a tetra-substituted thiourea compound is disclosed in JP-A-53-82408 and JP-A-55-77797. Preferred examples of such a thiourea compound include tetramethylurea and 1,3-dimethyl-2-imidazolidinethione.

In accordance with the controlled double jet process and the grain formation method using a silver halide solvent, a silver halide emulsion having a regular crystal from and a narrow grain size distribution can be easily formed. Thus, these methods are useful for the preparation of the silver halide emulsion to be used in the present invention.

In order to provide a uniform grain size, a method which comprises changing the rate at which a silver nitrate or halogenated alkali is added depending on the growth speed of grains as disclosed in British Patent 1,535,016, and JP-B-48-36890 and 52-16364 or a method which comprises changing the concentration of an aqueous solution as disclosed in British Patent 4,242,445, and JP-A-55-158124 may be used to allow grains to grow rapidly within the critical saturation degree.

The silver halide grains to be incorporated in the silver halide photographic material may comprise at least one metal selected from the group consisting of rhodium, rhenium, ruthenium, osmium and iridium to attain a high contrast and a reduced fog. The content of such a metal is preferably in the range of $1\times10^{-9}$ mol to $1\times10^{-5}$ mol, more preferably $1\times10^{-3}$ to $5\times10^{-6}$ mol per mol of silver. Two or more of such a metal may be used in combination. These metals may be uniformly incorporated in silver halide grains. Alternatively, these metals may be incorporated in silver halide grains with some distribution as described in JP-A-63-29603, JP-A-2-306236, JP-A-3-167545, and JP-A-4-76534, and Japanese Patent Application Nos. 4-68305 and 4-258187.

As the rhodium compound to be used in the present invention there may be used a water-soluble rhodium compound such as rhodium halide (III) compound and rhodium complex salt halogen, amine, oxalate, etc. as a ligand. Examples of such a water-soluble rhodium compound include hexachlororhodium (III) complex salt, hexabromorhodium (III) complex salt, hexaaminerhodium (II) complex salt, and trizalatorhodium (III) complex salt. These rhodium compounds may be used in the form of solution in water or a proper solvent. In order to stabilize the rhodium compound solution, a commonly practiced method may be used. That is, an aqueous solution of a halogenated hydrogen (e.g., hydrochloric acid, bromic acid, fluoric acid) or an alkali halide (e.g., KCl, NaCl, KBr, NaBr) may be used. Instead of using a water-soluble rhodium compound, other silver halide grains which have been doped with rhodium may be added to and dissolved in the system during the preparation of silver halide.

The incorporation of these compounds may be properly effected during the preparation of silver halide emulsion grains and any step before the coating of the emulsion. In particular, these compounds are preferably added to the system during the formation of the emulsion so that they can be incorporated in silver halide grains.

Rhenium, ruthenium and osminium to be used in the present invention may be added to the system in the form of water-soluble complex salt as described in JP-A-63-242, JP-A-1-285941, JP-A-2-20852, and JP-A-2-20855. Particularly preferred examples of such a water-soluble complex salt include hexacoordinated complexes represented by the following general formula:

$$[ML_6]^{-n}$$

wherein M represents Ru, Re or Os; and n represents an integer 0, 1, 2, 3 or 4.

In this case, paired ions are not important, and ammonium or aklaline metal ions are used.

Preferred examples of ligands include halide ligand, cyanide ligand, cyanate ligand, nitrosyl ligand, and thionitrosyl ligand. Specific examples of complexes which can be used in the present invention will be given below, but the present invention should not be construed as being limited thereto. $[ReCl_6]^{-3}$, $[ReBr_6]^{-3}$, $[ReCl_5(NO)]^{-2}$, $[Re(NS)Br_5]^{-2}$, $[Re(NO)(CN)_5]^{-2}$, $[Re(O)_2(CN)_4]^{-3}$, $[RuCl_6]^{-3}$, $[RuCl_4(H_2O)_2]^{-2}$, $[RuCl_3(NO)]^{-2}$, $[RuBr_5(NS)]^{-2}$, $[Ru(CN)_6]^{-4}$, $[Ru(CO)_3Cl_3]^{-2}$, $[Ru(CO)Cl_5]^{-2}$, $[OsCl_6]^{-6}$, $[OsCl_5(NO)]^{-8}$, $[Os(NO)(CN)_5]^{-6}$, $[Os(NS)Br_5]^{-2}$, $[Os(CN)_6]^{-4}$, $[Os(O)_2(CN)_4]^{-4}$.

The incorporation of these compounds may be properly effected during the preparation of silver halide emulsion grains and any step before the coating the emulsion. In particular, these compounds are preferably added to the system during the formation of the emulsion so that they can be incorporated in silver halide grains.

In order to add such a compound to the system during the formation of silver halide grains so that it is incorporated in the silver halide grains, various methods may be used. That is, such a compound may be added in the form of a powder or an aqueous solution with NaCl or KCl to a solution of a water-soluble salt or water-soluble halide during the formation of grains. Alternatively, when a silver salt and a halide solution are simultaneously added to the system, such a compound may be added to the system as a third solution. Thus, silver halide grains are formed in a triple jet process. Further, a necessary amount of an aqueous solution of a metal complex may be charged into the reaction vessel during the formation of grains. In particular, the first mentioned method is preferred.

In order to add such a compound to the surface of grains, a necessary amount of a metal complex may be charged into the reaction vessel shortly after the formation of grains or during or at the end of the physical ripening of the grains or during the chemical ripening of the grains.

As the iridium compound to be used in the present invention there may be used any of various iridium compounds. Examples of such an iridium compound include hexachloroiridium, hexaammineiridium, trioxalateiridium, and hexacyanoiridium. These iridium compounds may be used in the form of solution in water or a proper solvent. In order to stabilize the iridium compound solution, a commonly practiced method may be used. That is, an aqueous solution of a halogenated hydrogen (e.g., hydrochloric acid, bromic acid, fluoric acid) or an alkali halide (e.g., KCl, NaCl, KBr, NaBr) may be used. Instead of using a water-soluble iridium compound, other silver halide grains which have been doped with iridium may be added to and dissolved in the system during the preparation of silver halide.

The silver halide grains according to the resent invention may be doped with other heavy metal salts. In particular, an iron salt such as $K_4[Fe(CN)_6]$ may be advantageously used.

Further, the silver halide grains to be used in the present invention may comprise metal atoms such as cobalt, nickel, palladium, platinum, gold, thallium, copper and lead incorporated therein. The content of such a metal is preferably in the range of $1\times10^{-9}$ to $1\times10^{-4}$ mol per mol of silver halide. In order to incorporate such a metal in the silver halide grains, it may be added to the system during the formation of grains in the form of salt such as single salt, double salt and complex salt.

The silver halide emulsion according to the present invention may be subjected to chemical sensitization. In particular, commonly known methods such as sulfur sensitization, selenium sensitization, tellurium sensitization, reduction sensitization arid noble metal sensitization may be used singly or in combination. Preferred examples of such a combination include a combination of sulfur sensitization and gold sensitization, a combination of sulfur sensitization, selenium sensitization and gold sensitization, and a combination of sulfur sensitization, tellurium sensitization and gold sensitization.

The sulfur sensitization according to the present invention is normally carried out by stirring the emulsion at a temperature as high as 40° C. or more with a sulfur sensitizer added for a predetermined period of time. As such a sulfur sensitizer there may be used a known compound. For example, sulfur compounds contained in gelatin and various sulfur compounds such as thiosulfate, thiourea, thiazole and rhodanine may be used. Preferred sulfur compounds are thiosulfates and thiourea compounds. The amount of such a sulfur sensitizer to be added depends on various conditions such as pH and temperature an which the chemical sensitization is effected and size of silver halide grains but is normally in the range of $10^{-7}$ mol to $10^{-2}$ mol, preferably $10^{-5}$ mol to $10^{-3}$ mol per mol of silver halide.

As the selenium sensitizer to be used in the present invention there may be used a known selenium compound. In particular, the selenium sensitization may be normally carried out by stirring the emulsion at an elevated temperature, preferably 40° C. or higher, with an instable and/or instable type selenium compound added for a predetermined of time. As such an unstable type selenium compound there may be used a compound as described in JP-B-44-15748, JP-B-43-13489, Japanese Patent Application Nos. 2-130976, 2-229300, and 3-121798. In particular, compounds represented by the general formulae (VIII) and (IX) as disclosed in Japanese Patent Application No. 3-121798 are preferably used.

The tellurium sensitizer to be used in the present invention is a compound which causes silver telluride to be formed on the surface of or inside the silver halide grains as a prospective sensitized nucleus. The rate at which silver telluride is formed in the silver halide emulsion can be examined by the method described in Japanese Patent Application No. 4-146739.

Specifically, compounds as disclosed in U.S. Pat. Nos. 1,623,499, 3,320,069, and 3,772,031, British Patents 235,211, 1,121,496, 1,295,462, and 1,396,696, Canadian Patent No. 800,958, Japanese Patent Application Nos. 2-333819, 3-53693, 3-31598, and 4-129787, J. Chem. Soc. Chem. Commun., 635(1980), 1102(1979), (1979), J. Chem. Soc. Perkin. Trans., 1,2191 (1980), and S. Patai, "The Chemistry of Organic Serenium and Tellurium Compounds", Vol. 1 (1986), Vol. 2 (1987) may be used.

No particular limitations are imposed upon the various additives which can be used in the photosensitive materials, or upon the method of development processing, and those disclosed in the locations indicated below can be used for example.

| Item | Location |
|---|---|
| 1) Nucleation Accelerating Agents | Illustrative compounds II-1–II-22 and general formulae (II-m)–(II-p) from line 13 of the upper right column on page 9 to line 10 of the upper left column on page 16 of JP-A-2-103536, and the compounds disclosed in JP-A-1-179939. |
| 2) Spectrally Sensitizing Dyes | The spectrally sensitizing dyes disclosed from line 13 of the lower left column to line 4 of the lower right column on page 8 of JP-A-2-12236, from line 3 of the lower right column on page 16 to line 20 of the lower left column on page 17 of JP-A-2-103536, and in JP-A-1-112235, JP-A-2-124560, JP-A-3-7928 and Japanese Patent Application Nos. 3-189532 and 3-411064. |
| 3) Surfactants | From line 7 of the upper right column to line 7 of the lower right column on page 9 of JP-A-2-12236 and from line 13 of the lower left column on page 2 to line 18 of the lower right column on page 4 of JP-A-2-18542. |
| 4) Anti-foggants | From line 19 of the lower right column on page 17 to line 4 of the upper right column on page 18 and lines 1 to 5 of the lower right column on page 18 of JP-A-2-103536, and the thiosulfinic acid compounds disclosed JP-A-1 237538. |
| 5) Polymer Latexes | From line 12 to line 20 of the lower left column on page 18 of JP-A-2-103536. |
| 6) Compounds which have Acid Groups | From line 6 of the lower right column on page 18 to line 1 of the upper left column on page 19 of JP-A-2-103536. |
| 7) Matting Agents, Lubricants, Plasticizers | From line 15 of the upper left column on page 19 to line 15 of the upper right column on page 19 of JP-A-2-103536. |
| 8) Film Hardening Agents | From line 5 to line 17 of the upper right column on page 18 of JP-A-2-103536. |
| 9) Dyes | The dyes from line 1 to line 18 of the lower right column on page 17 of JP-A-2-103536, and the solid dyes disclosed in JP-A-2-294638 and Japanese Patent Application No. 3-185773. |
| 10) Binders | From line 1 to line 20 of the lower right column on page 3 of JP-A-2-18542. |
| 11) Anti-black Spotting Agents | The compounds disclosed in U.S. Pat. No. 4,956,257 and JP-A-1-118832. |
| 12) Redox Compounds | The compounds represented by general formula (I) (especially illustrative compounds 1 to 50) of JP-A-2-301743, the general formula (R-1), (R-2) and (R-3) and the illustrative compounds 1 to 75 disclosed on pages 3 to 20 of JP-A-3-174143, and the compounds disclosed in Japanese Patent Application Nos. 3-69466 and 3-15648. |
| 13) Mono-methine Compounds | The compounds of general formula (II) (especially illustrative compounds II-1 to II-26) of JP-A-2-287532. |
| 14) Dihydroxy-benzenes | The compounds disclosed from the upper left column on page 11 to the lower left column on page 12 of JP-A-3-39948, and in EP 452772A. |

The invention is described in practical terms below by means of illustrative examples, but the invention is not limited by these examples.

ILLUSTRATIVE EXAMPLES

EXAMPLE 1

Emulsion Preparation

Emulsion A

A 0.13M aqueous silver nitrate solution and aqueous halogen salt solution which contained 0.04M potassium bromide and 0.09M sodium chloride and which also contained $1\times10^{-7}$ mol per mol of silver of $(NH_4)_3RhCl_6$ were added using the double jet method over a period of 12 minutes at 38° C. with stirring to an aqueous gelatin solution which contained sodium chloride and 1,3-dimethyl-2-imidazolinethione. Silver chlorobromide grains of an average grain size 0.15 μm with a silver chloride content of 70 mol % were obtained, thereby nuclei formation was carried out in this way. Then a 0.87M aqueous silver nitrate solution and an aqueous halogen salt solution which contained 0.26M potassium bromide and 0.65M sodium chloride were added in the same way with the double jet method over a period of 20 minutes.

Subsequently, conversion was carried out with the addition of a $1\times10^{-3}$ mol KI solution, water washing was carried out using the flocculation method in the usual way, 40 grams of gelatin were added, the pH was adjusted to 6.5 and the pAg value was adjusted to 7.5, and then 5 mg of sodium thiosulfate and 8 mg of chloroauric acid were added, per mol of silver and chemical sensitization was carried out by heating to 60° C. for 60 minutes, after which 150 mg of 4-hydroxy-6-methyl-1,3,3a,7-tetraazaindene was added as a stabilizer. The grains obtained were cubic silver chlorobromide grains of an average grain size 0.27 μm with a silver chloride content of 70 mol %. (Variation coefficient 10%).

Preparation of Coated Samples

Compounds of this invention were added to the emulsions as indicated in Table 1. The comparative compounds for comparison with the hydrazine derivatives of this invention indicated below were used.

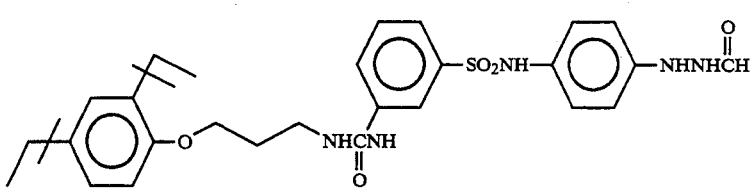

Comparative Compound A

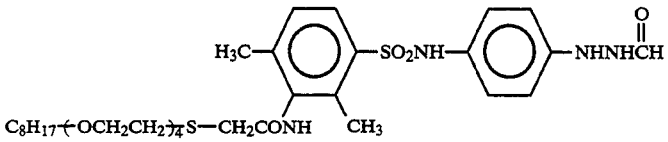

Comparative Compound B

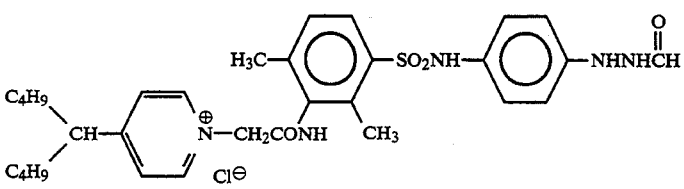

Comparative Compound C

Nucleation accelerating agents having the structural formulae indicated below were then added.

Nucleation Accelerating Agents

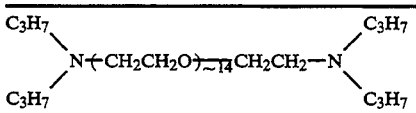

5 mg/m²

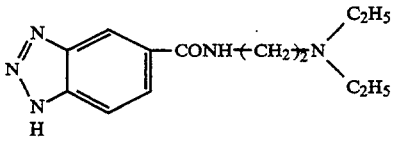

5 mg/m²

TABLE 1

| Sample | Hydrazine Derivative | Amount Added (mol/m²) |
|---|---|---|
| Comparative Examples | | |
| A | Comparative Compound A | $1.0 \times 10^{-5}$ |
| B | Comparative Compound B | $8.0 \times 10^{-5}$ |
| C | Comparative Compound C | $6.0 \times 10^{-5}$ |
| This Invention | | |
| D | Compound 1 | $4.0 \times 10^{-5}$ |
| E | Compound 19 | $4.0 \times 10^{-5}$ |
| F | Compound 12 | $2.5 \times 10^{-5}$ |
| G | Compound 25 | $1.5 \times 10^{-5}$ |
| H | Compound 3 | $1.5 \times 10^{-5}$ |

Moreover, the sensitizing dye of structural Formula ($S_1$) indicated below was added in an amount of $3.4 \times 10^{-4}$ mol per mol of silver, 1-phenyl-5-mercaptotetrazole was added in an amount of $2 \times 10^{-4}$ mol per mol of silver, the short wave cyanine dye represented by structural Formula (a) indicated below was added in an amount of $5 \times 10^{-4}$ mol per mol of silver, the latex represented by Formula (b) (200 mg/m²) was added, a poly(ethyl acrylate) dispersion (200 mg/m²) was added, and 1,3-divinylsulfonyl-2-propanol (200 mg/m²) was added as a film hardening agent.

Sensitizing Dye ($S_1$)

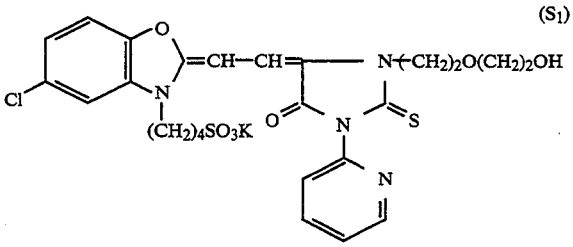

(a)

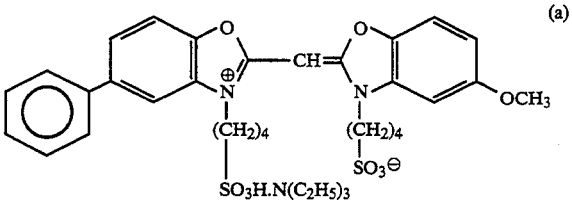

(b)

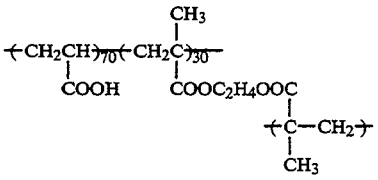

A protective layer containing 1.0 g/m² of gelatin, 40 mg/m² of amorphous $SiO_2$ matting agent of a particle size of about 3.5μ, 0.1 g/m² of methanol silica, 100 mg/m² of polyacrylamide, 200 mg/m² of hydroquinone, silicone oil and sodium dodecylbenzene sulfonate and the fluorine based surfactant the structural formula of which is indicated below as coating acids was coated simultaneously with the emulsion layer.

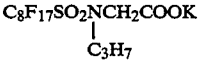

Furthermore, a backing layer and a backing layer protective layer the formulations of which are indicated below were also coated.

Backing Layer Formulation

| | |
|---|---|
| Gelatin | 3 g/m$^2$ |
| Latex: Poly(ethyl acrylate) | 2 g/m$^2$ |
| Surfactant: Sodium p-dodecylbenzene sulfonate | 40 mg/m$^2$ |
| Gelatin hardening agent | 110 mg/m$^2$ |
| $CH_2{=}CHSO_2CH_2CONH$ — $(CH_2)_2$ — $CH_2{=}CHSO_2CH_2CONH$ | |
| Fluorine based surfactant | 5 mg/m$^2$ |
| $C_8F_{17}SO_2N(C_3H_7)-CH_2COOK$ | |

Dye mixture of Dyes (a), (b) and (c)

Dye (a) 50 mg/m$^2$

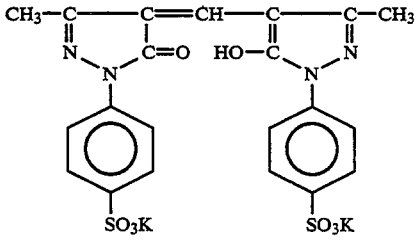

Dye (b) 100 mg/m$^2$

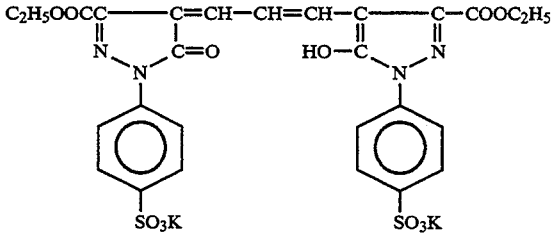

Dye (c) 50 mg/m$^2$

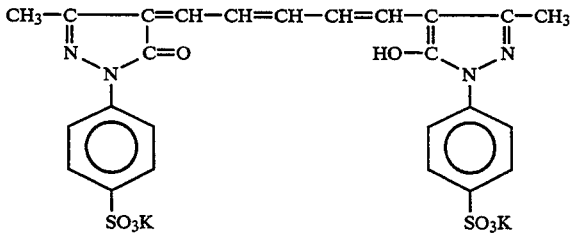

Backing Layer Protective Layer

| | |
|---|---|
| Gelatin | 0.8 g/m$^2$ |
| Fine poly(methyl methacrylate) particles (average particle size 4.5$\mu$) | 30 mg/m$^2$ |
| Dihexyl-$\alpha$-sulfosuccinate, sodium salt | 15 mg/m$^2$ |
| Dodecylbenzenesulfonic acid, sodium salt | 15 mg/m$^2$ |
| Sodium acetate | 40 mg/m$^2$ |

Evaluation of Photographic Characteristics

These samples were exposed through an optical wedge using tungsten light of 3200° K. and then they were developed for 25 seconds at 34° C. in Developer 1 indicated below, fixed, washed and dried. GR-F1 (manufactured by Fuji Photo Film Co., Ltd.) was used as a fixing solution.

Developer 1

| | |
|---|---|
| Hydroquinone | 30.0 grams |
| N-Methyl-p-aminophenol | 0.3 |
| Sodium hydroxide | 10.0 |
| Potassium sulfite | 60.0 |
| Ethylenediamine tetra-acetic acid, di-sodium salt | 1.0 |
| Potassium bromide | 10.0 |
| 5-Methylbenzotriazole | 0.4 |
| 2-Mercaptobenzimidazole-5-sulfonic acid | 0.3 |
| 3-(5-Mercaptotetrazole)benzenesulfonic acid, sodium salt | 0.2 |
| Sodium toluenesulfonate | 8.0 |
| Sodium carbonate | 11.0 |
| Water to make | 1 liter |
| Adjusted to pH 10.3 | |

Moreover, processing was also carried out in the same way using a process fatigued developer obtained after processing 15 full size (50.8 cm×61 cm) sheets of 100% blackened Fuji Lith Ortho Film RO- 100 per liter of developer in the developer of the aforementioned formulation, and using an aerial oxidation fatigued developer obtained by leaving the developer of the aforementioned formulation to stand in a beaker for 3 days.

The reciprocal of the exposure which gave a density of 1.0 was taken for the photographic speed, and the relative speeds with respect to the processing of Sample A in fresh developer are shown in Table 2. Furthermore, the gradient of the straight line joining the points of density 0.1 and 3.0 on the characteristic curve is similarly shown in Table 2 as the gradation.

TABLE 2

| | Photographic Speed | | | Gradation | | |
|---|---|---|---|---|---|---|
| Sample | Fresh Developer | Process Fatigued Developer | Aerial Oxidation Fatigued Developer | Fresh Developer | Process Fatigued Developer | Aerial Oxidation Fatigued Developer |
| Comparative Example | | | | | | |
| A | 100 | 90 | 115 | 10.7 | 9.1 | 6.2 |
| B | 104 | 83 | 121 | 9.9 | 6.7 | 6.3 |
| C | 106 | 83 | 125 | 10.3 | 6.8 | 6.1 |
| This Invention | | | | | | |
| D | 130 | 126 | 136 | 15.2 | 14.2 | 12.3 |
| E | 130 | 125 | 136 | 15.7 | 14.1 | 12.1 |
| F | 139 | 139 | 140 | 18.2 | 17.8 | 17.5 |
| G | 149 | 148 | 150 | 19.0 | 18.6 | 18.4 |
| H | 150 | 149 | 150 | 19.0 | 18.9 | 18.8 |

Photosensitive materials which have a high contrast even when processed in a developer of a pH less than 11 and with which the movement in photographic speed and gradation due to fluctuations in the developer composition is slight can be obtained by using the hydrazine derivatives of this invention.

EXAMPLE 2

The coated samples shown in Table 1 were developed in Developer 2 indicated below and the photographic characteristics were evaluated in the same way as in Example 1.

| | |
|---|---|
| Hydroquinone | 30.0 grams |
| N-Methyl-p-aminophenol | 0.3 |
| Sodium hydroxide | 10.0 |
| Potassium sulfite | 60.0 |
| Ethylenediamine tetra-acetic acid, di-sodium salt | 1.0 |
| Potassium bromide | 10.0 |
| 5-Methylbenzotriazole | 0.4 |
| 2-Mercaptobenzimidazole-5-sulfonic acid | 0.3 |
| 3-(5-Mercaptotetrazole)benzenesulfonic acid, sodium salt | 0.2 |
| Sodium toluenesulfonate | 8.0 |
| Sodium carbonate | 11.0 |
| N-Dimethyl-n-hexanolamine | 15.0 |
| Water to make | 1 liter |
| Adjusted to pH 9.8 | |

The photographic characteristics obtained are shown in Table 3.

TABLE 3

| Sample | Gradation |
|---|---|
| Comparative Example | |
| A | 9.9 |
| B | 9.8 |
| C | 9.2 |
| This Invention | |
| D | 16.3 |
| E | 16.2 |
| F | 17.5 |
| G | 18.6 |
| H | 19.1 |

As shown in Table 3, it is possible to obtain high contrast photographic performance with a developer of a lower pH by adding amine compounds to the developer.

EXAMPLE 3

This was the same as Example 1, except that an emulsion which had been prepared in the way described below was used, that the compound the structural Formula ($S_2$) of which is indicated below was used as a sensitizing dye, that hydrazine derivatives of this invention were added as indicated in Table 4, and that the development time was set to 45 seconds.

TABLE 4

| Sample | Hydrazine Derivative | Amount Added (mol/m$^2$) |
|---|---|---|
| Comparative Examples | | |
| A | Comparative Compound A | $2.0 \times 10^{-5}$ |
| B | Comparative Compound B | $1.5 \times 10^{-4}$ |
| C | Comparative Compound C | $1.5 \times 10^{-4}$ |
| This Invention | | |
| D | Compound 1 | $7.0 \times 10^{-5}$ |
| E | Compound 19 | $7.0 \times 10^{-5}$ |
| F | Compound 12 | $6.5 \times 10^{-5}$ |
| G | Compound 25 | $4.5 \times 10^{-5}$ |
| H | Compound 3 | $4.5 \times 10^{-5}$ |

Emulsion Preparation

A cubic mono-disperse silver iodobromide emulsion of grain size 0.25μ (variation coefficient 0.15, 1.0 mol % silver iodide, uniform iodine distribution) was prepared using the controlled double jet method. $K_3IrCl_6$ was added to this silver iodobromide emulsion in such a way that it contained $4\times10^{-7}$ mol per mol of silver.

The emulsion was de-salted using the flocculation method and then was maintained at 50° C., $10^{-3}$ mol per mol of silver of potassium iodide solution and $5\times10^{-4}$ mol per mol of silver of 4-hydroxy-6-methyl-1,3,3a,7-tetraazaindene as stabilizer, were added.

Sensitizing Dye ($S_2$)

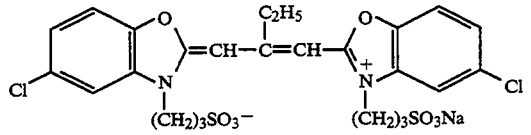

The photographic characteristics obtained are shown in Table 5.

TABLE 5

| Sample | Photographic Speed: Fresh Developer | Photographic Speed: Process Fatigued Developer | Photographic Speed: Aerial Oxidation Fatigued Developer | Gradation: Fresh Developer | Gradation: Process Fatigued Developer | Gradation: Aerial Oxidation Fatigued Developer |
|---|---|---|---|---|---|---|
| Comparative Example | | | | | | |
| A | 100 | 91 | 116 | 9.8 | 8.0 | 7.0 |
| B | 103 | 89 | 117 | 9.6 | 7.5 | 6.0 |
| C | 106 | 90 | 120 | 9.9 | 7.0 | 6.3 |
| This Invention | | | | | | |
| D | 144 | 137 | 145 | 12.0 | 11.4 | 10.9 |
| E | 143 | 140 | 147 | 12.3 | 11.7 | 11.2 |
| F | 151 | 149 | 151 | 13.6 | 13.4 | 13.1 |
| G | 160 | 159 | 161 | 15.6 | 15.0 | 14.6 |
| H | 161 | 161 | 162 | 15.0 | 14.8 | 14.6 |

As shown in Table 5, the samples of this invention provided images of high contrast even when processed in a developer of a pH less than 11, and the variation in photographic characteristics due to developer fatigue was also slight.

EXAMPLE 4

Emulsion Preparation

An aqueous solution of silver nitrate and an aqueous solution of sodium chloride were mixed simultaneously in an aqueous gelatin solution which was being maintained at 30° C. in the presence of $5.0\times10^{-6}$ mol per mol of silver of $(NH_4)_3RhCl_6$. Then, after removing the soluble salts using a method well known in the industry, gelatin was added and 2-methyl-4-hydroxy-1,3,3a-7-tetraazaindene was added as a stabilizer without carrying out chemical ripening. This emulsion was a mono-disperse emulsion of cubic crystalline form of an average grain size 0.08μ.

Preparation of Coated Samples

Compounds of this invention were added to the emulsion as indicated in Table 6. Then, the nucleation accelerating agents indicated by the structural formulae below were added.

Nucleation Accelerating Agents

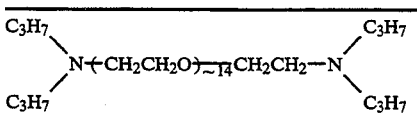

30 mg/m²

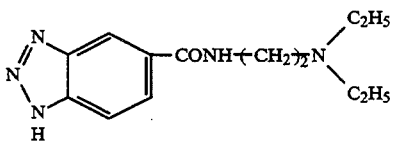

30 mg/m²

Moreover, poly(ethyl acrylate) latex was added in an amount of 30 wt % with respect to the gelatin in terms of the solid fraction, 1,3-vinylsulfonyl-2-propanol was added as a film hardening agent and the emulsions were coated on a polyester support to provide a silver weight of 3.8 g/m². The coated weight of gelatin was 1.8 g/m². A layer comprised of 1.5 g/m² of gelatin and 0.3 g/m² of poly(methyl methacrylate) of a particle size 3.5μ was coated over the top as a protective layer.

TABLE 6

| Sample | Hydrazine Derivative | Amount Added (mol/m²) |
|---|---|---|
| Comparative Examples | | |
| A | Comparative Compound A | $2.0\times10^{-5}$ |
| B | Comparative Compound B | $1.5\times10^{-4}$ |
| C | Comparative Compound C | $1.5\times10^{-4}$ |
| This Invention | | |
| D | Compound 1 | $1.0\times10^{-4}$ |
| E | Compound 19 | $1.0\times10^{-4}$ |
| F | Compound 12 | $8.0\times10^{-5}$ |
| G | Compound 25 | $7.0\times10^{-5}$ |
| H | Compound 3 | $7.0\times10^{-5}$ |

Evaluation of Photographic Characteristics

These samples were exposed through an optical wedge using a Daylight Printer P-607 made by the Dainippon Screen Co., developed for 40 seconds at 38° C. using Developer 1 and the process fatigued and aerial oxidation fatigued developers described in Example 1, fixed, washed and dried. The photographic characteristics obtained are shown in Table 7.

TABLE 7

| Sample | Photographic Speed: Fresh Developer | Photographic Speed: Process Fatigued Developer | Photographic Speed: Aerial Oxidation Fatigued Developer | Gradation: Fresh Developer | Gradation: Process Fatigued Developer | Gradation: Aerial Oxidation Fatigued Developer |
|---|---|---|---|---|---|---|
| Comparative Example | | | | | | |
| A | 100 | 89 | 116 | 9.3 | 8.7 | 7.0 |
| B | 101 | 84 | 120 | 9.0 | 8.6 | 7.3 |
| C | 102 | 86 | 124 | 8.9 | 8.0 | 6.9 |
| This Invention | | | | | | |
| D | 124 | 119 | 129 | 13.2 | 12.6 | 11.9 |

TABLE 7-continued

| | Photographic Speed | | | Gradation | | |
|---|---|---|---|---|---|---|
| Sample | Fresh Developer | Process Fatigued Developer | Aerial Oxidation Fatigued Developer | Fresh Developer | Process Fatigued Developer | Aerial Oxidation Fatigued Developer |
| E | 126 | 120 | 129 | 13.3 | 12.7 | 12.0 |
| F | 130 | 127 | 133 | 14.0 | 13.5 | 13.4 |
| G | 135 | 135 | 135 | 14.2 | 14.2 | 14.0 |
| H | 137 | 136 | 138 | 14.4 | 14.3 | 14.3 |

As is clear from Table 7, the samples of this invention provided high contrast images even on processing in a developer of a pH less than 11, and the variation in photographic characteristics due developer fatigue was also slight.

While the invention has been described in detail and with reference to specific embodiments thereof, it will be apparent to one skilled in the art that various changes and modifications can be made therein without departing from the spirit and scope thereof.

What is claimed is:

1. A silver halide photographic photosensitive material comprising a compound represented by the following general formula (I):

$$R^6\text{-}(L^1\text{-}R^1\text{-}A^{\oplus}\text{-}R^2\text{-}L^2\text{-}(R^3\text{-}L^3)_m\text{-}R^4\text{-}NHNH\text{-}G^1\text{-}R^5)_n \quad (I)$$
$$X^{\ominus}$$

wherein $L^1$ and $L^2$ represent a single bond, —O—, —S—, —$NR^7$—, —CO—, —$SO_2$—, —P(O) ($G^2R^7$)— or combinations of these groups, and $L^3$ represents —$SO_2NR^7$—, —$NR^7SO_2NR^7$—, —$CONR^7$—, —$NR^7CONR^7$— or —$G^2$P(O) ($G^2R^7$)$NR^7$—;

$G^1$ represents —CO—, —$SO_2$—, —SO—, —COCO—, a thiocarbonyl group, an iminomethylene group or —P(O) ($G^2R^7$)—, and $G^2$ represents a single bond, —O— or —$NR^7$—.

$R^1$, $R^2$, $R^3$ and $R^4$ represent divalent aliphatic groups or aromatic groups, $R^5$ represents a hydrogen atom, an aliphatic group, an aromatic group, an alkoxy group, an aryloxy group or a substituted or unsubstituted amino group, and $R^7$ represents a hydrogen atom, an aliphatic group or an aromatic group;

$A^{\oplus}$ represents a quaternary ammonium cation group, a tertiary sulfonium cation group or a quaternary phosphonium cation group;

m is 0 or 1 and n is 1 or 2, and $X^-$ represents a counter anion or a counter anion part in cases where an intramolecular salt is formed;

when n=1, $R^6$ represents an aliphatic group or aromatic group which contains a quaternary ammonium cation, a tertiary sulfonium cation or a quaternary phosphonium cation; and when n=2, $R^6$ represents a single bond, —O—, or a divalent aliphatic group or aromatic group.

2. The silver halide photographic material of claim 1, wherein $R^1$ and $R^2$ are alkylene groups.

3. The silver halide photographic material of claim 1, wherein $R^3$ and $R^4$ are arylene groups with contain a benzene ring.

4. The silver halide photographic material of claim 1, wherein $A^{\oplus}$ is a quaternary ammonium group.

5. The silver halide photographic material of claim 1, wherein $A^{\oplus}$ is a tertiary sulfonium group.

6. The silver halide photographic material of claim 1, wherein $A^{\oplus}$ is a quaternary phosphonium group.

7. The silver halide photographic material of claim 1, wherein n=1.

8. The silver halide photographic material of claim 1, wherein n=2.

9. A silver halide photographic photosensitive material comprising a support and at least one silver halide emulsion layer thereon, wherein at least one layer of said silver halide emulsion layer or hydrophilic colloidal layer other than said silver halide emulsion layer contains a compound represented by the following formula (I):

$$R^6\text{-}(L^1\text{-}R^1\text{-}A^{\oplus}\text{-}R^2\text{-}L^2\text{-}(R^3\text{-}L^3)_m\text{-}R^4\text{-}NHNH\text{-}G^1\text{-}R^5)_n \quad (I)$$
$$X^{\ominus}$$

wherein $L^1$ and $L^2$ represent a single bond, —O—, —S—, —$NR^7$—, —CO—, —$SO_2$—, —P(O) ($G^2R^2$)— or combinations of these groups, and $L^3$ represents —$SO_2NR^7$—, —$NR^7SO_2NR^7$—, —$CONR^7$—, —$NR^7CONR^7$— or —$G^2$P(O) ($G^2R^7$)$NR^7$—;

$G^1$ represents —CO—, —$SO_2$—, —SO—, —COCO—, a thiocarbonyl group, an iminomethylene group or —P(O) ($G^2R^7$)—, and $G^2$ represents a single bond, —O— or —$NR^7$—;

$R^1$, $R^2$, $R^3$ and $R^4$ represent divalent aliphatic groups or aromatic groups, $R^5$ represents a hydrogen atom, an aliphatic group, an aromatic group, an alkoxy group, an aryloxy group or a substituted or unsubstituted amino group, and $R^7$ represents a hydrogen atom, an aliphatic group or an aromatic group;

$A^{\oplus}$ represents a quaternary ammonium cation group, a tertiary sulfonium cation group or a quaternary phosphonium cation group;

m is 0 or 1 and n is 1 or 2, and $X^-$ represents a counter anion or a counter anion part in cases where an intramolecular salt is formed;

when n=1, $R^6$ represents an aliphatic group or aromatic group which contains a quaternary ammonium cation, a tertiary sulfonium cation or a quaternary phosphonium cation; and when n=2, $R^6$ represents a single bond, —O—, or a divalent aliphatic group or aromatic group.

* * * * *